United States Patent [19]

Knapp

[11] 4,309,836

[45] Jan. 12, 1982

[54] WIND DEFLECTABLE SIGN HOLDER

[75] Inventor: Michael Knapp, Elmira, N.Y.

[73] Assignee: Eastern Metal of Elmira, Inc., Elmira, N.Y.

[21] Appl. No.: 153,501

[22] Filed: May 27, 1980

[51] Int. Cl.[3] ..... G09F 7/00

[52] U.S. Cl. ..... 40/602; 40/606; 40/612

[58] Field of Search ..... 40/608, 602, 612, 607, 40/606, 10 R

[56] References Cited

U.S. PATENT DOCUMENTS

| | | | |
|---|---|---|---|
| 2,109,011 | 2/1938 | Joyce | 40/612 |
| 2,976,000 | 3/1961 | Gunderson | 40/608 |
| 3,875,720 | 4/1975 | Russell | 40/607 |

FOREIGN PATENT DOCUMENTS

| | | | |
|---|---|---|---|
| 1181967 | 6/1959 | France | 40/612 |

*Primary Examiner*—G. E. McNeill
*Assistant Examiner*—Wenceslao J. Contreras
*Attorney, Agent, or Firm*—Seidel, Gonda, Goldhammer & Panitch

[57] ABSTRACT

A sign panel is connected to a support frame therebelow by a resilient strip whose width is substantially greater than its thickness so that the sign panel may deflect in strong winds as permitted by the resilience of said strip. The effective length of said strip and hence the resilience thereof may be adjusted so that the maximum length of the strip is utilized under high wind conditions.

8 Claims, 6 Drawing Figures

WIND DEFLECTABLE SIGN HOLDER

BACKGROUND

The use of a plurality of springs to enable a sign panel to deflect under the effect of winds is known. See U.S. Pat. Nos. 3,646,696, 4,038,769 and 3,662,482. The teachings in said patents are not readily adaptable for use with a sign panel having a single support post of the type shown in U.S. Pat. No. 3,620,496. The present invention is directed to a solution of the problem of how to interrelate components of a sign of the type disclosed in the lastmentioned patent while being wind deflectable. Further, the present invention provides a solution for varying the deflectability of the sign panel as a function of wind conditions.

SUMMARY OF THE INVENTION

The present invention is directed to a sign holder in the form of apparatus for converting a sign panel rigidly connected to a frame therebelow so that the sign panel is wind deflectable.

The sign device includes a sign panel connected at its lower end to the upper end of a resilient strip whose width is substantially greater than its thickness so as to have two major faces. The sign panel and said strip are coupled together by an upper connector means. A lower connector means is associated with the lower end of said strip for coupling the lower end of said strip to a support frame therebelow.

The conversion apparatus is directed to a resilient strip whose width is substantially greater than its thickness so as to have two major faces. A connector means is secured to one major face of said strip adjacent one end portion and is adapted to support a sign thereabove. A connector means is secured to a major face of said strip adjacent the other end portion thereof for connecting said strip to a support frame therebelow whereby a sign panel coupled to the support frame by the strip will deflect due to winds as permitted by the resilience of said strip.

It is an object of the present invention to provide a novel wind deflectable sign holder.

It is another object of the present invention to provide conversion apparatus for converting a sign panel rigidly connected to a support frame therebelow so that the sign panel is wind deflectable.

It is another object of the present invention to provide for deflectability of a sign panel which is connected to a support frame therebelow by a single upright member.

It is another object of the present invention to provide adjustable wind deflectability for a sign holder for variable sizes of sign panels.

It is another object of the present invention to provide a wind deflectable sign holder which is simple, inexpensive, and reliable.

Other objects will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION

Figure 1:
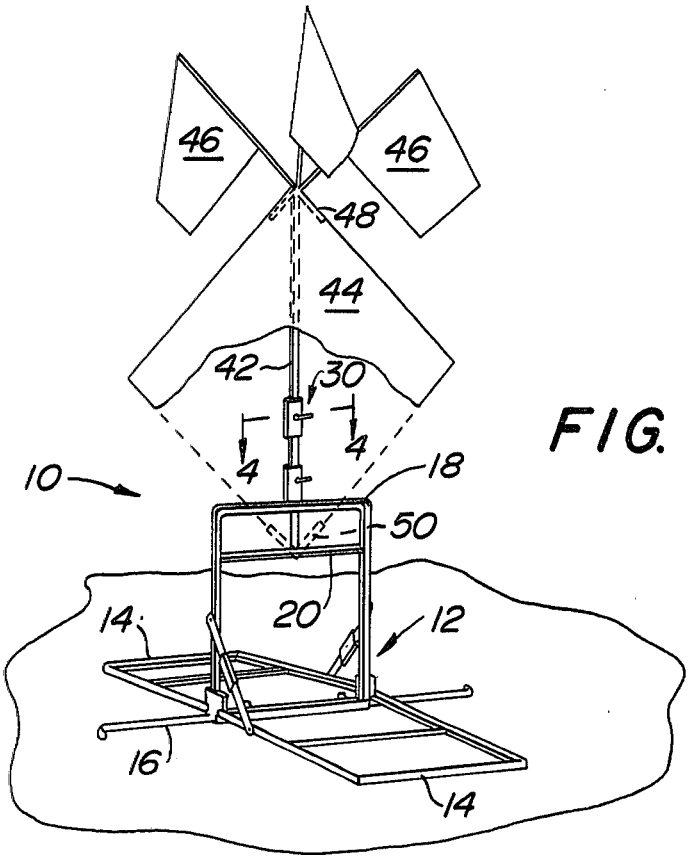
FIG. 1 is a perspective view of a typical sign device in accordance with the present invention.

Referring to the drawings in detail, wherein like numerals indicate like elements, there is shown in FIG. 1 a typical sign device in accordance with the present invention designated generally as 10. The particular sign device illustrated in FIG. 1 is of the type associated with work zone protection and would include indicia such as "danger", "men working", etc. The particular information on the sign panel per se forms no part of the present invention.

The sign device 10 is provided with a support frame 12. The support frame 12 per se may be conventional. As illustrated, support frame 12 includes a pair of ground engaging members 14 pivotably connected to an upstanding frame member 18. The lower end of the frame member 18 has adjustable outriggers 16. The frame member 18 may have a transversely disposed brace 20.

Figure 2:
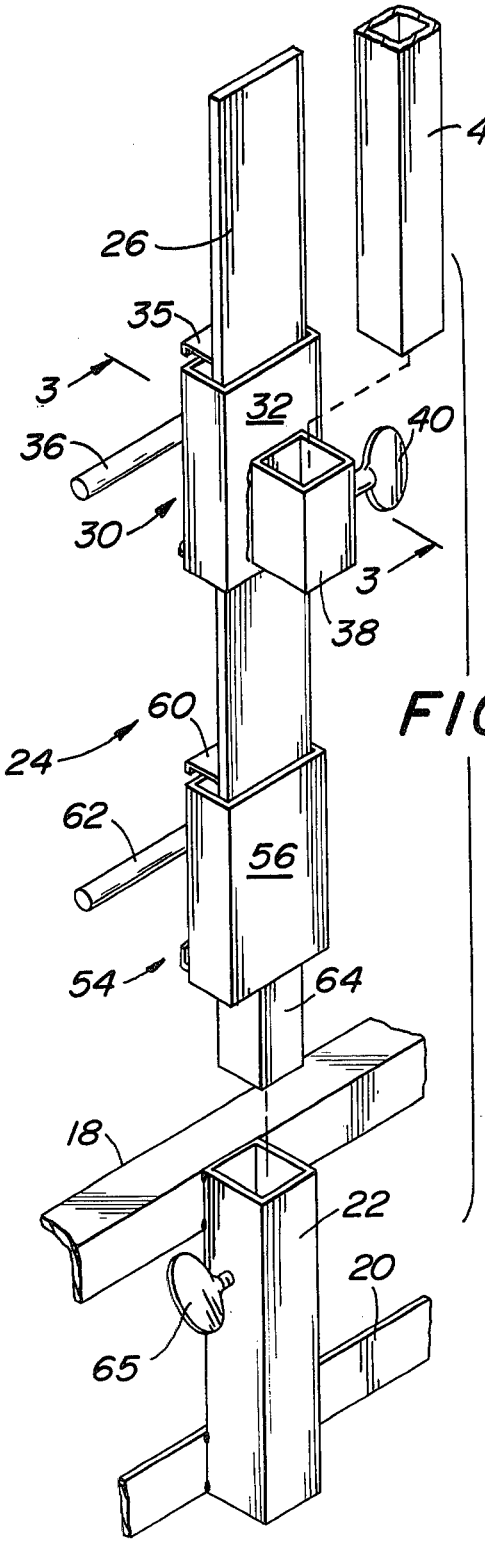
FIG. 2 is a partial perspective view of a portion of the sign device shown in FIG. 1.

As shown more clearly in FIG. 2, a socket 22 is fixedly secured to the frame member 18 and brace 20. Socket 22 is open at both ends and may be in the form of a rectangular tube having one side welded to the frame member 18 and brace 20.

Figure 4:
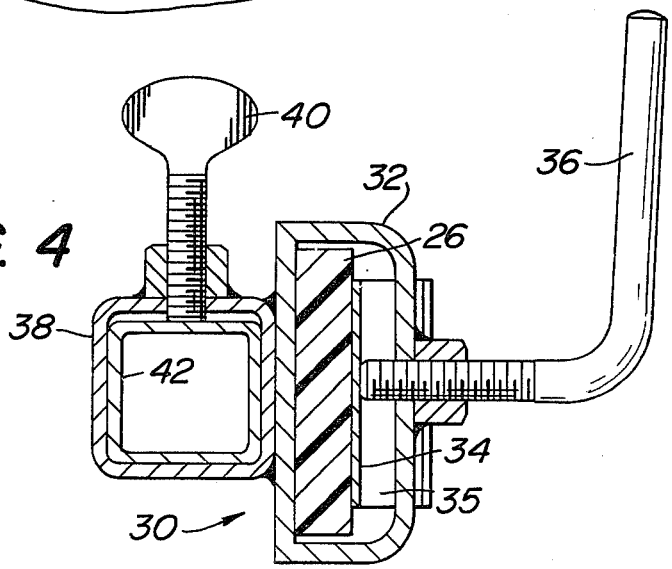
FIG. 4 is a sectional view taken along the line 4—4 in FIG. 1.

Conversion apparatus or sign holder designated generally as 24 and shown in FIG. 2 is provided for converting a sign panel rigidly connected to the support frame 12 so that the sign panel may be wind deflectable. The sign holder 24 includes a flexible, resilient strip 26. Strip 26 has a width substantially greater than its thickness so as to have two major faces. The preferred embodiment is to provide the strip 26 with uniform thickness. See FIGS. 2 and 4. Further, the preferred embodiment is to use a strip 26 made from 30% polymeric plastic material such as a polyester containing 10% filler by weight and reinforced with 70% longitudinally extending fibers of fiberglass. Strip 26 is non-corrosive and other resilient plastic materials as well as resilient metal strips may be used.

A connector means 30 is coupled to one end of the strip 26 such as the upper end thereof. The connector means 30 includes a casing 32 through which the strip 26 extends. Casing 32 is open at both ends and has a width which is greater than the thickness of strip 26. A pressure plate 34 is juxtaposed to one of the major faces of the strip 26 and is prevented from separating from the casing 34 by flanges 35 at each end thereof. A handle 36 is threaded through a nut welded onto the casing 32 and acts as a set screw for securing casing 32 to the strip 26 by way of the pressure plate 34.

A channel 38 which is preferably non-circular in cross-section is fixedly secured to one face of the casing 32 in any convenient manner such as by welding. The channel 38 is adapted to receive the lower end of a standard 42. Standard 42 is adjustably coupled to the channel 38 by means of a set screw 40. See FIGS. 2 and 4. The upper end of the standard 42 is connected to the sign panel 44 by way of a V-shaped bracket 48. A similar bracket 50 on the lower end of the sign panel 44 may be fixedly secured to the brace 20. If desired, the bracket 48 may support a plurality of flags 46.

Figure 3:
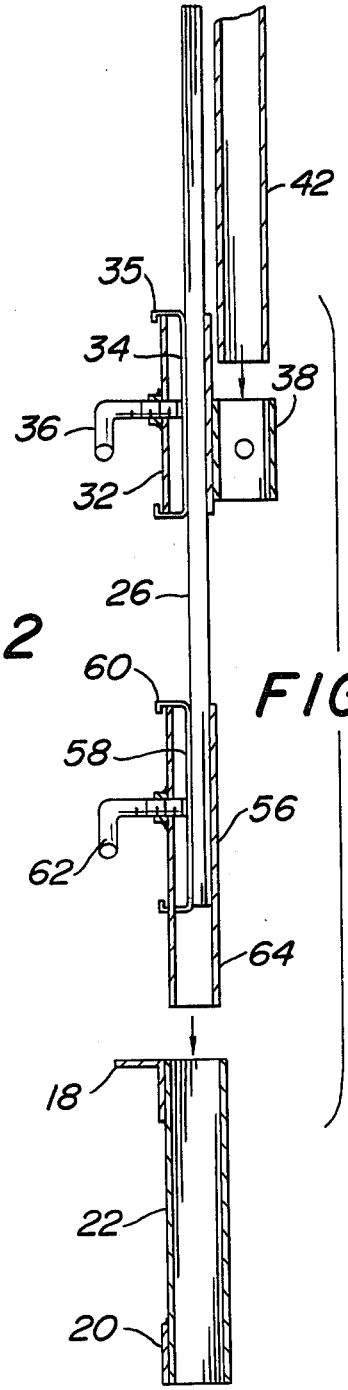
FIG. 3 is a sectional view taken along the line 3—3 in FIG. 2.

A connector means 54 is coupled to the lower end portion of the strip 26. See FIGS. 2 and 3. The connector means 54 includes a casing 56 open at both ends. A pressure plate 58 is provided within the casing 56 and has a flange 60 which projects from the casing 56. A handle 62 is threaded to a nut welded to the casing 56 and acts as a set screw for retaining the lower end portion of strip 26 coupled to the connector means 54. A projection 64 forms a continuation of the casing 56. Projection 64 is non-circular in cross-section and has its upper end fixedly secured to the lower end of casing 56. Since the cross-section of the projection 64 is less than that of the casing 56, the lower end of strip 26 rests on the upper end of projection 64. Projection 64 is configured so as to telescope into the socket 22 for selective retention by thumb screw 65.

The thusly described sign holder 24 and/or conversion apparatus facilitates deflection of the sign panel 44 in different wind conditions. The sign holder 24 is preferably adjustable due to the manner in which strip 26 is coupled to sign connector means 30. In a typical working embodiment, the strip 26 is 18 inches long, 2 inches wide, and has a maximum thickness across the flats 28 of $\frac{3}{8}$ inch. The strip 26 preferably has a modulus of elasticity in the range of $2.5\times10^5$ to $6\times10^5$ psi when sign panel 44 has an exposed face of 16 ft.$^2$. In FIG. 1, the connector means 30 is at the upper end of the strip 26 whereby the maximum length of strip 26 is utilized for maximum wind conditions or for sign panels greater than 16 ft.$^2$. Under less than maximum wind conditions and/or with sign panels less than 16 ft.$^2$, the connector means 30 may be adjusted so as to be closer to the connector means 54 as shown in FIG. 2 whereby less than the entire length of the strip 26 is utilized.

Figure 5:
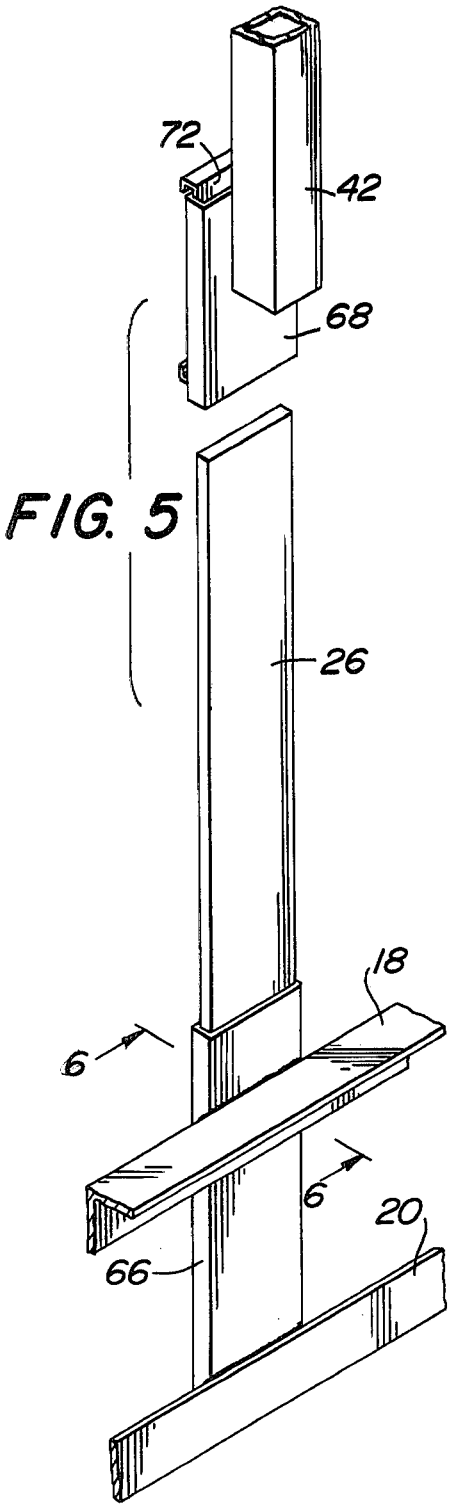
FIG. 5 is a partial perspective view similar to FIG. 2 but showing another embodiment of the present invention.
Figure 6:
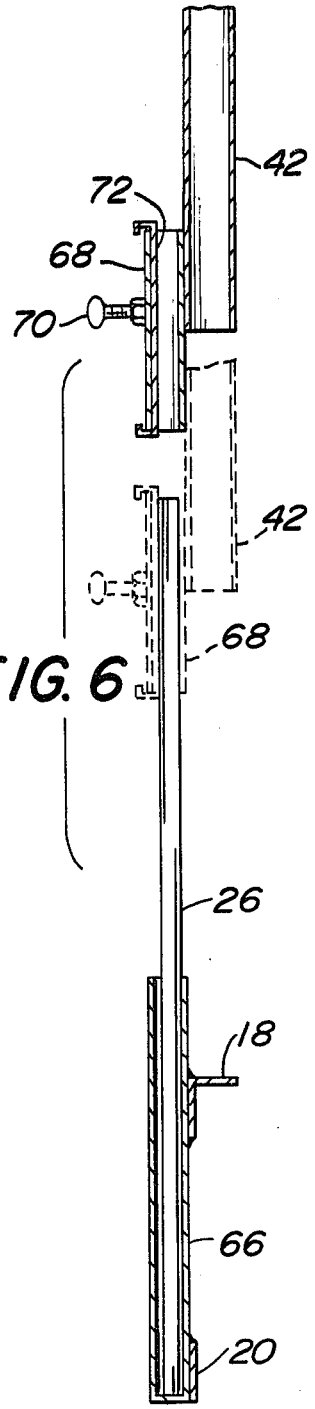
FIG. 6 is a sectional view taken along the line 6—6 in FIG. 5.

In FIGS. 5 and 6, there is illustrated the revelant portion of another embodiment of the present invention which is otherwise identical with that shown in FIGS. 1–4. As shown in FIG. 5, the socket 66 may be closed at its lower end and shaped in section so as to match the shape of the cross-section of strip 26. The lower end portion of strip 26 is merely telescoped into the socket 66. Thus, the socket 66 performs the function of connector means 54.

A socket 68 is fixedly secured to the lower end of the support standard 42. Socket 68 is open at its upper end portion. A thumb screw 70 and pressure plate 72 are provided for socket 68 so that it may be adjustably coupled to strip 26. Thus, the sign panel 44 is coupled to its support stand by way of the strip 26 and is capable of being readily disassembled with the use of only one set screw.

In each embodiment of the present invention, the sign panel will deflect under the effect of wind as permitted by the resilience of the strip 26. In each embodiment, the components are readily disassembled and are capable of being rapidly assembled at any particular location where it is desired to have the sign device. The strip 26 is preferably non-metallic so as to be non-corrosive. In each embodiment shown, the effective length of the strip 26 is adjustable.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for converting a sign panel rigidly connected to a support frame therebelow in a manner so that the sign panel is wind deflectable comprising:

(a) a resilient strip of material whose width is substantially greater than its thickness so as to have two major faces, (b) an upper connector means secured to one major face of said strip adjacent one end portion and adapted to support a sign panel thereabove with the sign panel generally parallel to said one face, lower connecting means secured to a major face of said strip adjacent the other end portion thereof for connecting said strip to a support frame therebelow, one of said connector means being adjustable along the length of said strip for varying the effective length of the strip to adjust the effective resilience of said strip, (c) whereby a sign panel coupled to a support frame by said strip will deflect in wind as permitted by the resilience of said strip.

2. Apparatus in accordance with claim 1 wherein at least one of said connector means is secured to a major face of said strip by way of a pressure plate and a handle supported in a manner so that one end of the handle contacts one face of the pressure plate while the other face of the pressure plate is in contact with said strip.

3. Apparatus in accordance with claim 1 wherein said strip is a reinforced polymeric plastic material.

4. Apparatus in accordance with claim 3 wherein said strip is a polyester internally reinforced with fiberglass.

5. Apparatus in accordance with claim 1 wherein said strip has a length of about 18 inches, a width of about 2 inches, and a maximum thickness of about $\frac{3}{8}$ inch.

6. A wind deflectable sign device comprising a sign panel, said panel being coupled to the upper end of a resilient strip whose width is substantially greater than its thickness, the length of said strip being substantially greater than its width, a connector means which is open at its upper end, the lower end of said strip being telescoped into said connector means, said connector means being connected to the upper end of an upright support frame therebelow, said support frame having ground engaging members pivotably connected to the lower end thereof, whereby the sign panel will deflect in wind as permitted by the resilience of said strip, and means associated with said connector means for adjusting the effective resilience of said strip.

7. A wind deflectable sign device comprising a sign panel, a resilient strip whose width is substantially greater than its thickness, upper connector means telescoped with respect to said strip and secured to one major piece of said strip adjacent the upper end portion of said strip, said upper connector means being connected to and supporting said sign panel, a lower connector means telescoped with respect to a lower end of said strip and secured to one major face of the strip, an upright support frame, said lower connector means being fixedly connected to the upper end of said frame, a pair of ground engaging members pivotably connected to the lower end of said frame and being collapsible upwardly so as to be on opposite sides of said frame, bracket means extending between said ground engaging members and said frame for retaining said members in a ground engaging position generally perpendicular to said frame, whereby the sign panel will deflect in wind as permitted by the resilience of said strip.

8. Apparatus in accordance with claim 7 wherein at least one of said connector means is adjustably secured to a major face of said strip by way of a pressure plate and a handle supported in a manner so that one end of the handle contacts one face of the pressure plate while the other face of the pressure plate is in contact with a major face of said strip to thereby facilitate varying the effective length of the strip to adjust the effective resilience of said strip.

* * * * *